US005864348A

United States Patent [19]

Fritsch et al.

[11] Patent Number: 5,864,348

[45] Date of Patent: Jan. 26, 1999

[54] CLEANING DEVICE AND A METHOD FOR CLEANING AN INK JET PRINTING HEAD

[76] Inventors: Joseph F Fritsch; Roxanne Y Fritsch, both of 114 Lansdowne Park, Ballsbridge, Dublin 4, Ireland

[21] Appl. No.: 499,242

[22] Filed: Jul. 7, 1995

[51] Int. Cl.[6] ..... B41J 2/165

[52] U.S. Cl. ..... 347/22; 347/32; 347/33; 347/35

[58] Field of Search ..... 206/229, 223, 206/215, 576; 347/22, 33, 28, 35; 15/104.92, 114; 220/694, 737

[56] References Cited

U.S. PATENT DOCUMENTS

| | | | |
|---|---|---|---|
| 4,306,245 | 12/1981 | Kasugayama et al. | 347/33 |
| 4,437,568 | 3/1984 | Hamblin | 206/223 |
| 4,727,986 | 3/1988 | Feldstein | 206/229 |
| 4,868,700 | 9/1989 | Fritsch et al. | 360/128 |
| 5,500,658 | 3/1996 | Hattori et al. | 347/22 |
| 5,557,306 | 9/1996 | Fukushima et al. | 347/33 |

*Primary Examiner*—Benjamin R. Fuller
*Assistant Examiner*—Thien Tran
*Attorney, Agent, or Firm*—Sughrue, Mion, Zinn, Macpeak & Seas, PLLC

[57] ABSTRACT

A cleaning device for cleaning a printing head of an ink jet cartridge of an ink jet printer comprises a box having a base closed by a lid. A resilient support pad laminated to the base supports a cleaning member for cleaning the printing head. The cleaning member comprises a backing sheet laminated to the support pad, and a plurality of upstanding fibres woven into and extending upwardly from the backing sheet. The maximum dimension of the fibres is less than the minimum dimension of the ink jet orifices of the printing head for enabling the fibres to project into the ink jet orifices for cleaning thereof. The fibres are of hydrophobic material but are packed sufficiently tightly together for retaining a cleaning liquid by a capillary type action therebetween.

19 Claims, 1 Drawing Sheet

CLEANING DEVICE AND A METHOD FOR CLEANING AN INK JET PRINTING HEAD

FIELD OF THE INVENTION

The present invention relates to a cleaning device for cleaning a printing head, and in particular, for cleaning a printing head of an ink jet cartridge of an ink jet printer. Such printing heads are of the type which comprise a head portion, and an orifice plate having one or more jet orifices for directing one or more ink jets for printing is located in the head portion.

BACKGROUND TO THE INVENTION

In general, ink jet cartridges are provided complete with a charge of ink, and when the ink runs out, the cartridge is replaced with a fresh cartridge. The cartridge is provided with a printing head which is provided with an orifice plate having a plurality of jet orifices through which respective jets of ink are directed at a page to form print or other characters. In normal use, and in particular, during periods of non-use, the jet orifices may become blocked or partially blocked with dried and congealed ink. Known methods for cleaning the printing head of an ink jet cartridge, in general, comprise wiping the printing head with a cloth or tissue which may or may not have a cleaning liquid or cleaning solvent absorbed therein. However, by virtue of the fact that the blockages, tend to occur well in the jet orifices, known methods have been found unsatisfactory for completely unblocking a blocked or partially blocked jet orifice. Accordingly, because of this once any of the jet orifices of a printing head of an ink jet cartridge become blocked or partly blocked, in general, it is necessary to dispose of the cartridge and replace it with a fresh cartridge. This is relatively wasteful, since in many cases the cartridge being disposed of may have been little used and may be virtually fully charged with ink.

There is therefore a need for a cleaning device for cleaning the printing head of an ink jet cartridge, and indeed, for cleaning other printing heads which are of the type which comprise one or more jet orifices for directing one or more ink jets for printing.

OBJECTS OF THE INVENTION

The present invention is directed towards providing a cleaning device for cleaning a printing head, and in particular, for cleaning a printing head of an ink jet cartridge of an ink jet printer. In particular, it is an object of the invention to provide such a cleaning device for cleaning the jet orifices in such a printing head, and in particular, for unblocking blocked and partially blocked jet orifices of a printing head.

SUMMARY OF THE INVENTION

According to the invention there is provided a cleaning device for cleaning a printing head of the type which comprises one or more jet orifices for directing one or more ink jets for printing, the cleaning device comprising:

- a base,
- a support pad of resilient material laminated to the base, and
- a cleaning member for cleaning the printing head, the cleaning member comprising
  - a backing sheet which is laminated to the support pad, and
  - a plurality of upstanding cleaning fibres of hydrophobic material extending upwardly from the backing sheet for cleaning the printing head and the jet orifices, the cleaning fibres being located sufficiently closely together so that adjacent cleaning fibres interact with each other for retaining a cleaning liquid with a capillary type action therebetween.

Preferably, the maximum transverse cross-sectional dimension of each of the cleaning fibres is less than the minimum transverse cross-sectional dimension of the jet orifices for facilitating entry of the cleaning fibres into the jet orifices for cleaning thereof.

Advantageously, the transverse cross-sectional area of the respective cleaning fibres is such that the cleaning fibres co-operate with the jet orifices for delivering the cleaning liquid into the respective jet orifices by capillary action between the cleaning fibres and the jet orifices for cleaning thereof.

Typically, the cleaning fibres may be of transverse cross-sectional diameter in the range of 10 microns to 60 microns, but preferably, the transverse cross-sectional diameter of the cleaning fibres is in the range of 20 microns to 50 microns. Typically, the cleaning fibres are of height extending from the backing sheet in the range of 1 mm to 3 mm, and preferably, the height of the cleaning fibres is in the range of 1.5 mm to 2 mm. In practice, it is preferable that the cleaning fibres should be of similar height so as to provide a substantially even pile for cleaning. While it is preferable that the transverse cross-sectional diameter of the cleaning fibres should be similar, the transverse cross-sectional diameter of the cleaning fibres may vary within a reasonable range, and indeed, may vary within the ranges 10 microns to 60 microns, and 20 microns to 50 microns.

In one aspect of the invention the cleaning fibres are of a non-absorbing material, for preventing absorbtion into the respective cleaning fibres of ink from the printing head. For example, the cleaning fibres are of polypropylene material.

Preferably, the backing sheet is a woven sheet, and the cleaning fibres are woven into the backing sheet, and preferably, the backing sheet is of hydrophobic material.

Advantageously, the support pad is of sponge type construction, and the support pad is of sponge type material of closed cell construction.

In one aspect of the invention the support pad is of plastics material.

In another aspect of the invention a portion of the support pad to which the backing sheet is laminated is exposed for facilitating cleaning of the printing head thereon.

Preferably, the base, the support pad and cleaning member are of a material which may be rinsed in water.

In another aspect of the invention the base forms the base of a box, and a lid co-operates with the base for defining a hollow interior region, the lid being movable relative to the base between an open condition opening the hollow interior region and a closed condition closing the hollow interior region, the support pad and cleaning member being located within the hollow interior region.

Preferably, the lid is hingedly connected to the base, and releasable retaining means are mounted on the lid and base, respectively, for releasably retaining a container for containing a cleaning liquid in engagement with the box while the lid is in the closed condition, the retaining means being movable apart for releasing the container on the lid being moved into the open condition.

In one aspect of the invention the cleaning device is for cleaning a printing head of an ink jet cartridge of an ink jet printer.

Additionally, the invention provides a method for cleaning a printing head of the type which comprises one or more jet orifices for directing one or more ink jets for printing, the method comprising the steps of:

providing a cleaning member laminated to a support pad of resilient material which in turn is laminated to a base, the cleaning member comprising a backing sheet which is laminated to the support pad, and a plurality of upstanding cleaning fibres of hydrophobic material extending upwardly from the backing sheet, applying a cleaning liquid to a portion of the cleaning member so that the cleaning liquid is retained between the cleaning fibres of the cleaning member by capillary action, placing the printing head on the moistened portion of the cleaning member and moving the printing head from side to side against the moistened portion of the cleaning member so that the cleaning fibres apply the cleaning liquid to the printing head and the cleaning fibres extend into the ink jet orifices for delivering the cleaning liquid into the jet orifices by capillary action, and subsequently drawing the printing head against and along a dry portion of the cleaning member for drying thereof.

Preferably, the printing head is gently urged against the cleaning member during cleaning and drying, and is gently moved on the cleaning member during cleaning and drying.

Advantageously, the printing head is maintained in contact with the moistened portion of the cleaning member until substantially all blocked and partially blocked jet orifices have been unblocked.

In one aspect of the invention the printing head is maintained in contact with the moistened portion of the cleaning member for a time period in the range of 15 to 30 seconds.

In another aspect of the invention the cleaning liquid is an alcohol based solvent.

Ideally, the printing head is gently pressed into engagement with an exposed surface of the support pad adjacent the cleaning member for removing external dry ink from the printing head.

ADVANTAGES OF THE INVENTION

The advantages of the invention are many. By virtue of the fact that the cleaning fibres are of transverse cross-section such as to permit entry into the jet orifices of the printing head, cleaning and unblocking of the jet orifices is readily easily achieved. Furthermore, and most importantly, by virtue of the fact that the cleaning fibres are arranged on the backing sheet sufficiently closely together that the cleaning fibres interact with adjacent cleaning fibres for retaining a cleaning liquid with a capillary action, cleaning liquid is readily available for application to the printing head and the jet orifices. Additionally, by virtue of the fact that the transverse cross-section of the cleaning fibres is such as to facilitate delivery of cleaning liquid into the jet orifices by capillary type action, an adequate supply of cleaning liquid is delivered into the jet orifices for dissolving, and thus removing dried and congealed ink which may be blocking or partly blocking the jet orifices. By providing the cleaning fibres of transverse cross-sectional diameter in the range of 10 microns to 60 microns, the cleaning device is suitable for cleaning the printing head of most ink jet cartridges. In general, cleaning fibres having transverse cross-sectional diameters within this range are suitable for delivering cleaning liquid into the jet orifices of the orifice plate of the majority of printing heads. However, some printing heads are provided with orifice plates having jet orifices of transverse cross-sectional diameter of approximately 60 microns, and in such cases, it is desirable that the transverse cross-sectional diameter of the cleaning fibres should not exceed 50 microns, and preferably, should lie in the range 10 microns to 50 microns.

Furthermore, by virtue of the fact that the cleaning fibres and the backing sheet are of hydrophobic material, and do not absorb cleaning liquid and water based liquids, the cleaning fibres can readily easily be cleaned by merely rinsing the cleaning member in water. Indeed, by virtue of the fact that the cleaning fibres are hydrophobic, and do not absorb water based liquids, such as printing ink, cleaning printing ink from the cleaning fibres is a simple task, which merely requires rinsing any ink adhering to the outer surfaces of the cleaning fibres therefrom with water.

A further advantage of the invention is that the cleaning member, including the backing sheet and the cleaning fibres, tends to take up the shape of the printing head, and in particular, tends to take up the shape of the printing head adjacent the orifice plate during cleaning. This provides particularly good cleaning of the printing head, the orifice plate and the jet orifices in the orifice plate, due to the fact that the cleaning fibres tend to follow the shape and contours of the printing head adjacent the orifice plate. In other words, the pile of the cleaning member formed by the cleaning fibres tends to take up the form and shape of the printing head. This is achieved by a combination of the pile of the cleaning member formed by the cleaning fibres, and the fact that the backing sheet of the cleaning member is laminated to and supported on the support pad which is of a resilient material. By virtue of the fact that the support pad is of a resilient material, the support pad temporarily deforms to partly take up the shape of the printing head, while the cleaning fibres can also bend resiliently due to their transverse cross-sectional dimension. Accordingly, on a printing head being gently pressed into the cleaning member, the support pad is deformed and the cleaning fibres also slightly deform to thereby substantially take up the form and shape of the printing head. On removal of the printing head from the cleaning member, the support pad and the cleaning fibres return to their normal configuration. It is also believed that the height of the cleaning fibres facilitates in the cleaning member substantially taking up the form and shape of the printing head during cleaning.

These and other advantages and objects of the invention will be readily apparent to those skilled in the art from the following description of a preferred embodiment thereof which is given by way of example only with reference to the accompanying drawings.

DETAILED DESCRIPTION OF THE INVENTION

Figure 4:
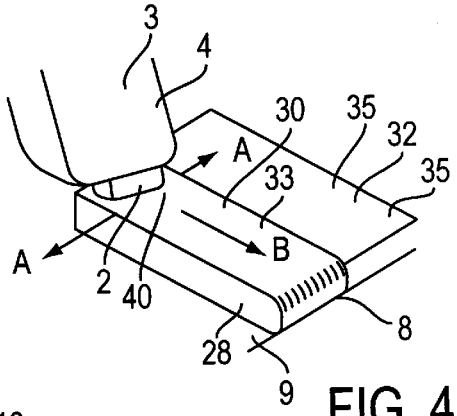
FIG. 4 is a perspective view of portion of the cleaning device of FIG. 1 in use.

Referring to the drawings there is illustrated a cleaning device according to the invention indicated generally by the reference numeral 1 for cleaning a printing head 2 of an ink jet cartridge 3. A portion of the ink jet cartridge 3 is illustrated in FIG. 4. Such ink jet cartridges 3 are of the type which are normally used in ink jet printers, and will be well known to those skilled in the art. In general, they include a container portion 4 which is charged with ink. The printing head 2 is secured to the container portion 4 and is provided with an orifice plate (not shown) having a plurality of jet orifices (also not shown) through which respective ink jets are directed towards the page for forming printed characters. The cleaning device 1 is particularly suitable for cleaning the printing head 2, and in particular, for unblocking blocked and partially blocked jet orifices in the orifice plate of the printing head.

Figure 1:
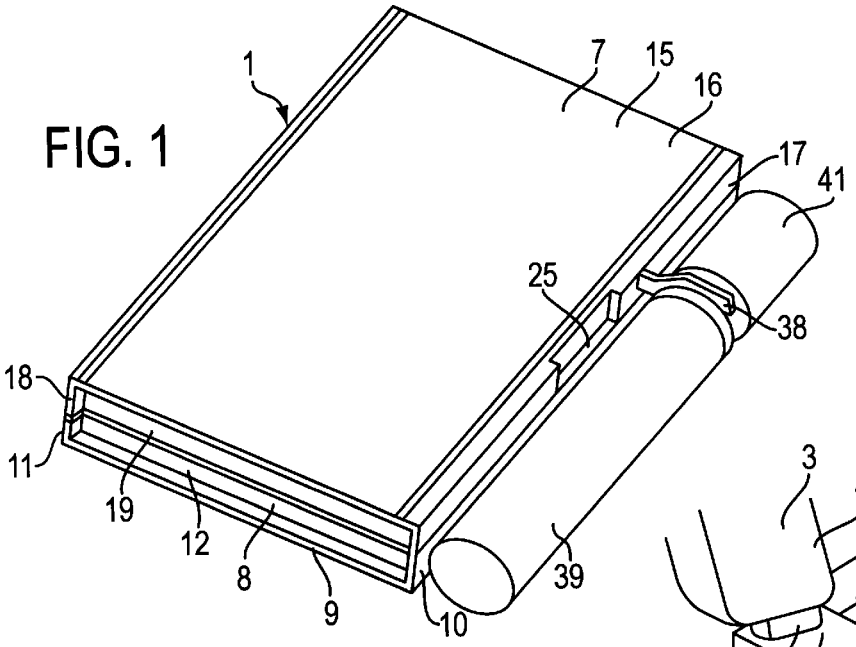
FIG. 1 is a perspective view of a cleaning device according to the invention for cleaning a printing head of an ink jet cartridge.
Figure 2:
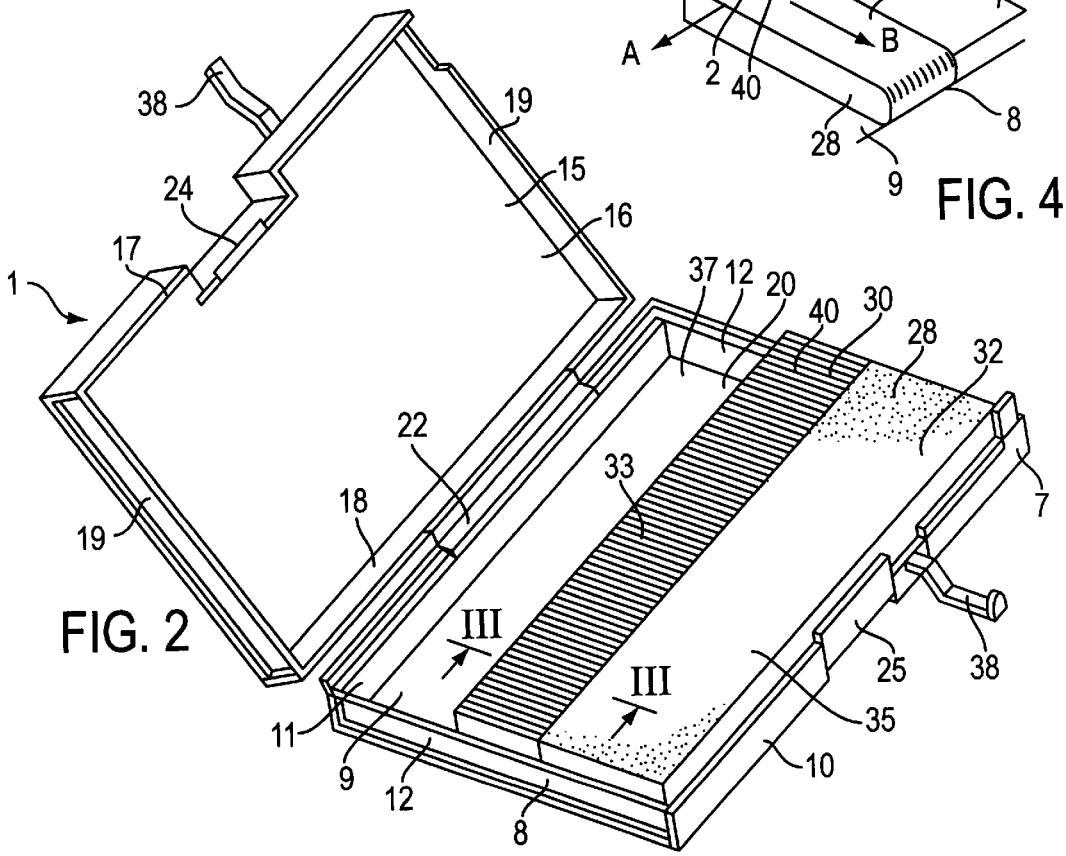
FIG. 2 is a perspective view of the cleaning device of FIG. 1 open.
Figure 3:
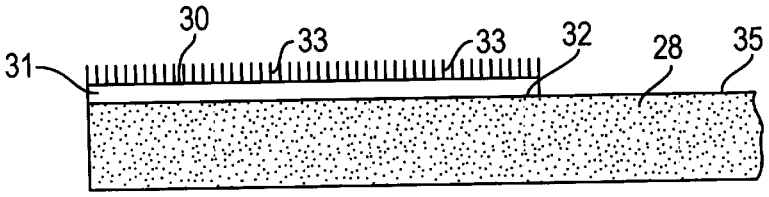
FIG. 3 is a cross-sectional end elevational view of portion of the cleaning device of FIG. 1 on the line III—III of FIG. 2.

The cleaning device 1 comprises a box 7 of injection moulded plastics material comprising a base portion 8 having a base 9, front and rear side walls 10 and 11, respectively, and end walls 12 extending from the base 9. A lid 15 having a top wall 16 and front and rear side walls 17 and 18, respectively, and end walls 19 extending from the top wall 16 define with the base portion 8 a hollow interior region 20. A plastics hinge 22 integrally formed during injection moulding of the box 7 is formed between the rear side walls 11 and 18 of the base portion 8 and lid 15, respectively, for hinging the lid 15 relative to the base portion 8. The lid 15 is hingeable relative to the base portion 8 between an open condition illustrated in FIG. 2 opening the hollow interior region 20, and a closed condition illustrated in FIG. 1 closing the hollow interior region 20. A latch 24 extending from the front side wall 17 of the lid 15 releasably engages a corresponding receiver 25 on the front side wall 10 of the base portion 8 for releasably securing the lid 15 to the base portion 8 in the closed condition.

A support pad 28 of resilient plastics material of closed cell sponge type construction is laminated to a portion of the base 9 by a suitable adhesive for supporting a cleaning member 30 for cleaning the printing head 2 as will be described below. The cleaning member 30 comprises a backing sheet 31 of hydrophobic, non-absorbing woven material such as polypropylene, and a plurality of upstanding cleaning fibres 33 woven into and extending upwardly from the backing sheet 31. The backing sheet 31 is laminated to a surface 32 of the support pad 28 by a suitable adhesive. The cleaning fibres 33 are of a hydrophobic, non-absorbing material such as polypropylene. The transverse cross-section of the cleaning fibres 33 is such as to permit entry of the cleaning fibres 33 into the jet orifices (not shown) of the printing head 2. The cleaning fibres 33 are arranged on the backing sheet 31 at a density sufficiently close together so that adjacent cleaning fibres 33 interact with each other for retaining a cleaning liquid therebetween with a capillary type action. Accordingly, although the cleaning fibres 33 themselves are hydrophobic, nonetheless the cleaning member 30 retains the cleaning liquid by virtue of the capillary action between adjacent cleaning fibres 33. The cleaning fibres 33 are of transverse cross-sectional diameter of 20 microns to 40 microns, and are of height from the backing sheet 31 of approximately 1.75 mm. By virtue of their height and transverse cross-sectional diameter, the cleaning fibres are resilient, and thus bend under gentle pressure from a printing head being gently pressed into the cleaning member. However, on removal of the printing head, the cleaning fibres spring back to their normal configuration.

A portion 35 of the surface 32 of the support pad 28 is exposed, and this surface also facilitates in cleaning the printing head 2 as will be described below. The support pad 28 forms with the base portion 8 and the lid 15 a compartment 37 in the hollow interior region 20 which may be used for storing protective tabs for covering printing heads and for protecting the orifice plate of the printing head.

A pair of retaining means, namely, retaining clips 38 extend from the front side walls 10 and 17 of the base portion 8 and lid 15, respectively, and co-operate with each other when the lid 15 and base portion 8 are in the closed condition for engaging and retaining an elongated tubular container 39 adjacent the box 7. The tubular container 39 contains the cleaning liquid, which in this case is an alcohol based solvent. The container 39 is released by the retaining clips 38 on the lid 15 and base portion 8 being hinged into the open condition. The tubular container 39 is provided with a wick type felt tip (not shown) for applying the cleaning liquid to a portion of the cleaning member 30 prior to cleaning. A releasable cap 41 protects the felt tip (not shown). Such tubular containers with wick type felt tips will be known to those skilled in the art. The tubular container 39 may be resilient for facilitating dispensing of cleaning liquid through the wick type felt tip by squeezing the tubular container 39.

In use, to clean the printing head 2 of an ink jet cartridge 3, a portion, for example, the portion 40 illustrated in FIG. 4 is lightly moistened with the cleaning liquid from the tubular container 39. This is achieved by wiping the wick type felt tip (not shown) against the cleaning member 30. Typically, an area which constitutes approximately one eighth of the total surface area of a cleaning member 30 is moistened with the cleaning liquid, and preferably, the moistened portion is to one end of the cleaning member 30. The printing head 2 of the ink jet cartridge 3 is then gently brought into contact with the moistened portion 40 of the cleaning member 30 with the orifice plate (not shown) of the printing head 2 abutting the cleaning member 30 and engaging the cleaning fibres 33. The printing head 2 is gently moved from side to side in the direction of the arrows A against the cleaning member 30 so that the orifice plate (not shown) of the printing head 2 is moved over the cleaning fibres 33. During this side to side movement of the printing head 2 some of the cleaning fibres 33 of the cleaning member 30 project into the ink jet orifices, and with the aid of capillary action introduce cleaning liquid into the jet orifices. The cleaning liquid coupled with the agitating movement of the cleaning fibres 33 loosens and dissolves any dried congealed ink which is blocking or partially blocking the jet orifices. This gentle side to side movement of the printing head 2 against the moistened portion 40 of the cleaning member 30 is continued until the printing head 2 is cleaned and all the blocked and partially blocked jet orifices have been unblocked. Typically, this should be achieved within fifteen to thirty seconds, and in many cases within fifteen to twenty seconds. After the cleaning part of the operation has been completed, the printing head 2 with the orifice plate (not shown) of the printing head in contact with the cleaning fibres 33, is drawn gently along the cleaning member 30 from the moistened portion 40 to the opposite end of the cleaning member 30 in the direction of the arrow B for drying the printing head 2 and the jet orifices. The printing head 2 should now be fully cleaned and ready for use. Any ink removed from the printing head 2 and from the jet orifices is retained between the cleaning fibres 33 by the capillary action, and can be cleaned away as described below.

In the event of minor blockages occurring in any of the jet orifices of the orifice plate of the printing head, the printing head 2 and the orifice plate (not shown) of the printing head 2 may be gently pressed against the exposed portion 35 of the surface 32 of the support pad 28, and in general, on lifting of the printing head 2 from the portion 35 of the surface 32 any minor blockages should be cleared. It has been found that such minor blockages may be cleared in this way irrespective of whether the cleaning liquid has been applied to the exposed portion 35 of the surface 32 of the support pad 28. Why minor blockages may be cleared in this way is not fully understood, however, it is believed that possibly a suction action is induced between the orifice plate and the exposed portion 35 of the surface 32 of the support pad 28, and as pressure is being released on the printing head and just before the printing head commences to disengage from the support pad 28, the induced suction may clear minor blockages in the jet orifices.

The box 7, support pad 28 and cleaning member 30 are all washable, and accordingly, to clean the cleaning device 1 the box 7 with the lid 15 in the open condition is placed under a stream of tap water and rinsed. During rinsing, the cleaning member 30 and support pad 28 are rubbed gently with the finger or a suitable brush or other cleaning aid for rinsing ink from the cleaning fibres 33 and the cleaning member 30, and the device 1 is then allowed to dry.

Should the wick type felt tip (not shown) of the tubular container 39 dry out, the wick type felt tip can be readily recharged, provided the container still contains cleaning liquid. This is achieved by inverting the container 39 with the wick type felt tip extending downwardly therefrom, and by gently squeezing the tubular body portion of the container for urging the cleaning liquid through the felt tip.

It is also envisaged that the cleaning fibres may be electrically conductive, and in which case, they would dissipate any static charges of electricity which may have accumulated on the printing head. Dissipation of such static charges would be further facilitated by providing an electrically conductive backing sheet. The cleaning fibres and the backing sheet may be of an inherently electrically conductive material, or they may be provided with a coating of an electrically conductive material, for example, the cleaning fibres may be coated with an electrically conductive material, such as, for example, silver and the like. The cleaning fibres may be of polypropylene, nylon or the like and coated with a relatively thin film of silver. In similar fashion, the backing sheet may also be made electrically conductive.

We claim:

1. A cleaning device for cleaning a printing head which comprises one or more jet orifices for directing one or more ink jets for printing, the cleaning device comprising:

a base, a cleaning member for cleaning the printing head, the cleaning member comprising a backing sheet, and plurality of upstanding cleaning fibres of hydrophobic material extending upwardly from the backing sheet for cleaning the printing head and the jet orifices, the cleaning fibres being located sufficiently closely together so that adjacent cleaning fibres interact with each other for retaining a cleaning liquid with a capillary type action therebetween, the cleaning fibres being of transverse cross-sectional area such that the cleaning fibres co-operate with the jet orifices for delivering the cleaning liquid into the jet orifices by capillary action between the cleaning fibres and the jet orifices for cleaning thereof, and a support pad of resilient material being located between and laminated to the base and the backing sheet for supporting the cleaning member.

2. A cleaning device as claimed in claim 1 in which the transverse cross-sectional area of each of the cleaning fibres is less than the minimum transverse cross-sectional area of the jet orifices for facilitating entry of the cleaning fibres into the jet orifices for cleaning thereof.

3. A cleaning device as claimed in claim 1 in which the cleaning fibres are of a non-absorbing material, for preventing absorbtion of ink by the cleaning fibres from the printing head.

4. A cleaning device as claimed in claim 1 in which the cleaning fibres are of polypropylene.

5. A cleaning device as claimed in claim 1 in which the backing sheet is a woven sheet, and the cleaning fibres are woven into the backing sheet.

6. A cleaning device as claimed in claim 1 in which the backing sheet is of hydrophobic material.

7. A cleaning device as claimed in claim 1 in which the support pad is of sponge type construction, and the support pad is of sponge type material of closed cell construction.

8. A cleaning device as claimed in claim 1 in which the support pad is of plastics material.

9. A cleaning device as claimed in claim 1 in which a portion of the support pad to which the backing sheet is laminated is exposed for facilitating cleaning of the printing head thereon.

10. A cleaning device as claimed in claim 1 in which the base, the support pad and the cleaning member are of a water rinsable material.

11. A cleaning device as claimed in claim 1 in which the base is formed by a base wall of a box, and a lid co-operates with the base wall for defining a hollow interior region, the lid being movable relative to the base wall between an open condition opening the hollow interior region and a closed condition closing the hollow interior region, the support pad and cleaning member being located within the hollow interior region.

12. A cleaning device as claimed in claim 11 in which the lid is hingedly connected to the base wall, and a releasable retaining means is mounted on the lid and the base wall, respectively, for releasably retaining a container for containing a cleaning liquid in engagement with the box while the lid is in the closed condition, the retaining means being movable apart for releasing the container on the lid being moved into the open condition.

13. A method for cleaning a printing head which comprises one or more jet orifices for directing one or more ink jets for printing, the method comprising the steps of:

providing a cleaning member laminated to a support pad of resilient material which in turn is laminated to a base, the cleaning member comprising a backing sheet which is laminated to the support pad, and a plurality of upstanding cleaning fibres of hydrophobic material extending upwardly from the backing sheet, the cleaning fibres being located sufficiently closely together so that adjacent cleaning fibres interact with each other for retaining a cleaning liquid with a capillary type action therebetween, the cleaning fibres being of transverse cross-sectional area such that the cleaning fibres co-operate with the jet orifices for delivering the cleaning liquid into the jet orifices by capillary action between the cleaning fibres and the jet orifices for cleaning thereof, applying a cleaning liquid to a portion of the cleaning member so that the cleaning liquid is retained between the cleaning fibres of the cleaning member by capillary action to form a moistened portion of the cleaning member, cleaning the printing head by placing the printing head on the moistened portion of the cleaning member and moving the printing head from side to side against the moistened portion of the cleaning member so that the cleaning fibres apply the cleaning liquid to the printing head and the cleaning fibres extend into the ink jet orifices for delivering the cleaning liquid into the jet orifices by capillary action, and subsequently drying the printing head by drawing the printing head against and along a dry portion of the cleaning member.

14. A method as claimed in claim 13 in which the method comprises the further steps of gently urging the printing head against the cleaning member during cleaning and drying of the printing head, and gently moving the printing head on the cleaning member during cleaning and drying of the printing head.

15. A method as claimed in claim 13 in which the method comprises the further step of maintaining the printing head in contact with the moistened portion of the cleaning member during cleaning of the printing head until substantially all blocked and partially blocked jet orifices have been unblocked.

16. A method as claimed in claim 13 in which the method comprises the further step of maintaining the printing head in contact with the moistened portion of the cleaning member during cleaning thereof for a time period in a range of 15 seconds to 30 seconds.

17. A method as claimed in claim 13 in which the cleaning liquid is an alcohol based solvent.

18. A method as claimed in claim 13 in which the method further includes the step of gently pressing the printing head into engagement with an exposed surface of the support pad adjacent the cleaning member for removing external dry ink from the printing head.

19. A cleaning device for cleaning a printing head of an ink jet cartridge of an ink jet printer wherein the printing head comprises one or more jet orifices for directing one or more ink jets for printing, the cleaning device comprising:

a base, a cleaning member for cleaning the printing head, the cleaning member including:

a backing sheet, and a plurality of upstanding cleaning fibres of hydrophobic material extending upwardly from the backing sheet for cleaning the printing head and the jet orifices, the cleaning fibres being located sufficiently closely together so that adjacent cleaning fibres interact with each other for retaining a cleaning liquid with a capillary type action therebetween, the cleaning fibres being of transverse cross-sectional area such that the cleaning fibres co-operate with the jet orifices for delivering the cleaning liquid into the jet orifices by capillary action between the cleaning fibres and the jet orifices for cleaning thereof, and a support pad of resilient material being located between and laminated to the base and the backing sheet for supporting the cleaning member.

* * * * *